US009035834B2

(12) United States Patent
French et al.

(10) Patent No.: US 9,035,834 B2
(45) Date of Patent: May 19, 2015

(54) VEHICLE ANTENNA

(71) Applicant: Imagination Technologies Limited, Kings Langley (GB)

(72) Inventors: Carl French, Dunstable (GB); David H. Griffiths, Whitchurch Hill (GB); Weiming Fu, Watford (GB)

(73) Assignee: Imagination Technologies Limited, Kings Langley (GB)

( * ) Notice: Subject to any disclaimer, the term of this patent is extended or adjusted under 35 U.S.C. 154(b) by 0 days.

(21) Appl. No.: 14/030,174

(22) Filed: Sep. 18, 2013

(65) Prior Publication Data

US 2014/0055308 A1 Feb. 27, 2014

Related U.S. Application Data

(63) Continuation of application No. PCT/GB2012/000303, filed on Apr. 2, 2012.

(30) Foreign Application Priority Data

Apr. 7, 2011 (GB) ..... 1105959.0

(51) Int. Cl.
*H01Q 1/32* (2006.01)
*H01Q 1/12* (2006.01)
(Continued)

(52) U.S. Cl.
CPC ..... *H01Q 1/3291* (2013.01); *H01Q 1/32* (2013.01); *H01Q 1/1285* (2013.01); *H01Q 1/325* (2013.01); *H01Q 1/48* (2013.01); *H01Q 9/30* (2013.01)

(58) Field of Classification Search
CPC ..... H01Q 1/32; H01Q 1/3275; H01Q 1/3291
USPC ..... 343/713, 711
See application file for complete search history.

(56) References Cited

U.S. PATENT DOCUMENTS 4,764,773 A 8/1988 Larsen et al.
5,023,622 A 6/1991 Blaese
(Continued)

FOREIGN PATENT DOCUMENTS

DE 4318869 A 12/1994
JP 2002158516 A 5/2002
JP 2008-172626 A 7/2008

OTHER PUBLICATIONS

International Search Report in PCT/GB2012/000303, mailed on Jun. 22, 2012.
(Continued)

*Primary Examiner* — Hoang V Nguyen
(74) *Attorney, Agent, or Firm* — Vorys, Sater, Seymour and Pease LLP; Vincent M DeLuca; Michael S. Garrabrants

(57) ABSTRACT

An RF antenna system is provided for mounting on a window of a vehicle comprising exterior and interior window mountable portions. The first and second portions include an RF coupling section (4) to inductively couple an RF signal received from antenna (20) and a power coupling section (6) for providing external power to an external amplification portion 52 for amplifying received RF signals. The system includes a further electrical connection (16) to a metallic shim (18) which is magnetically fixed to the roof of the vehicle and electrically connected thereto, whereby the roof provides a ground plane for the antenna, by capacitive coupling of the metallic shim to the vehicle roof.

20 Claims, 4 Drawing Sheets

(51) Int. Cl.
*H01Q 1/48* (2006.01)
*H01Q 9/30* (2006.01)

(56) References Cited

U.S. PATENT DOCUMENTS 5,278,572 A 1/1994 Harada et al.
5,619,214 A 4/1997 Lindenmeier et al.
6,008,767 A * 12/1999 Taniguchi et al. ..... 343/713
6,232,926 B1 5/2001 Nguyen et al.
6,417,810 B1 * 7/2002 Huels et al. ..... 343/713
6,768,467 B2 * 7/2004 Jordan ..... 343/713
8,026,858 B2 * 9/2011 Takaba et al. ..... 343/713

OTHER PUBLICATIONS

Written Opinion in PCT/GB2012/000303.

* cited by examiner

VEHICLE ANTENNA

CROSS REFERENCE TO RELATED APPLICATIONS

This application is a U.S. continuation application of a Patent Cooperation Treaty Application Serial No. PCT/GB2012/000303, filed on Apr. 2, 2012, which claims priority from United Kingdom Application Serial No. GB 1105949.0, filed on Apr. 7, 2011, both of which are entitled "Vehicle Antenna" and are incorporated by reference in the present application in their entireties and for all purposes.

BACKGROUND

1. Field

This invention relates to a radio antenna suitable for fitting to a motor vehicle such as a car, and in particular, to an antenna which is able to receive digital audio broadcast (DAB) transmissions for use with a DAB receiver positioned within the vehicle.

2. Related Art

Digital audio broadcasting (DAB) is now well established in the United Kingdom and various other European countries and is also now becoming better established in further countries worldwide. It is expected that over a number of years, there will be a switch off of FM transmissions in countries where DAB becomes established.

Many motor vehicles are equipped with FM/AM radio receivers and have antennas only capable of receiving signals for these frequencies, for example, FM frequency signals are in the band 87.5 MHz to 108 MHz. DAB transmissions come in two frequency bands, band 3 is 174 MHz to 240 MHz, and band L is 1452 MHz to 1490 MHz. Due to the different frequency bands, if the radio receiver in a vehicle is to be upgraded to a DAB receiver from an FM/AM receiver then a different antenna will be required on that vehicle to receive signals. Several different Antennas for after-market fit to vehicles have already been proposed and all of these have drawbacks.

Windscreen film antennas are antennas printed on plastic film which are stuck to the inside of a vehicle's windscreen, they can be active or passive antennas. Although they are aesthetically fairly discreet, they suffer from performance issues which arise mainly because they are mounted on the inside of a vehicle windshield. Due to the mounting position they suffer shadowing from the roof and the rest of the structure of the vehicle, which will result in a reduction in nominal performance and a further reduction still depending on the vehicle's orientation to the transmitter. Furthermore, some windscreens have coatings to reflect UV or glare and these coatings can themselves effect reception of an antenna fixed to the inside of the windscreen.

Magmount antennas are usually mounted on the roof of a vehicle. They are a monopole structure and the antenna base is a magnet and is therefore magnetically attracted to the roof. The position of the antenna above the roofline gives this antenna good performance. However, the antenna requires a coaxial cable to connect to a radio receiver inside the vehicle and this will require some routing through a window seal or by making a hole in the bodywork of the vehicle.

External glass-mounted antennas are mounted outside the vehicle and therefore above the roofline, this gives them good omnidirectional performance. However, the antenna being monopole in structure requires a ground plane if it is to provide good performance, particularly with Band 3 reception which covers a wide frequency bandwidth. A further performance reduction arises because of the loss of signal incurred when coupling the signal through the glass. This effects the sensitivity of the receiver as there is no amplification of the signal prior to this loss and therefore the signal to noise ratio (SNR) of the received signal will be compromised.

SUMMARY

A vehicle antenna is described which can be retrofitted, which has a wide bandwidth suitable for receiving RF signals (such as DAB) with a non-intrusive installation and minimizes antenna shadowing due to vehicle roof and other structure; it provides the antenna with a sufficiently large ground plane via capacitive coupling to the vehicle roof, and minimizes coupling loss through a window via external amplification of the received signal.

In accordance with an embodiment of the invention there is provided

In examples, the RF signal from the antenna is electrically coupled through an inductive coupling network mounted on the window. Examples also include coupling to provide power for external amplification of the antenna signal.

Embodiments will now be described in detail by way of example with reference to the accompanying drawings in which:

DETAILED DESCRIPTION

There are a number of criteria which the examples described below seek to address.

Firstly, it is desirable that a monopole antenna mounted on a vehicle should have a ground plane to enable it to achieve its full bandwidth, efficiency and required omnidirectional performance. The ground plane area should ideally be larger than ¼ of the wavelength of the received signal frequency in each direction. For example, for DAB reception this equates to an area of roughly 1.2 $m^2$. A typical vehicle roof is larger than this and therefore works well as a ground plane for DAB frequency reception. There are already through-glass antenna systems available but existing systems do not use the roof as a ground plane by capacitively coupling to it.

Secondly, it is desirable to position the antenna outside the vehicle and above the roofline without having to drill holes in the body of the vehicle or to obtain access to the wiring of the vehicle.

Thirdly, it is desirable to have RF coupling through the window using adhesive mountings, and to provide DC power to a low noise amplifier (LNA) connected to the Antenna on the outside of the window. The use of the LNA ensures the RF signal coupling losses do not affect the SNR of the received signal. The power is preferably provided using an inductive power coupling through the window.

Figure 1:
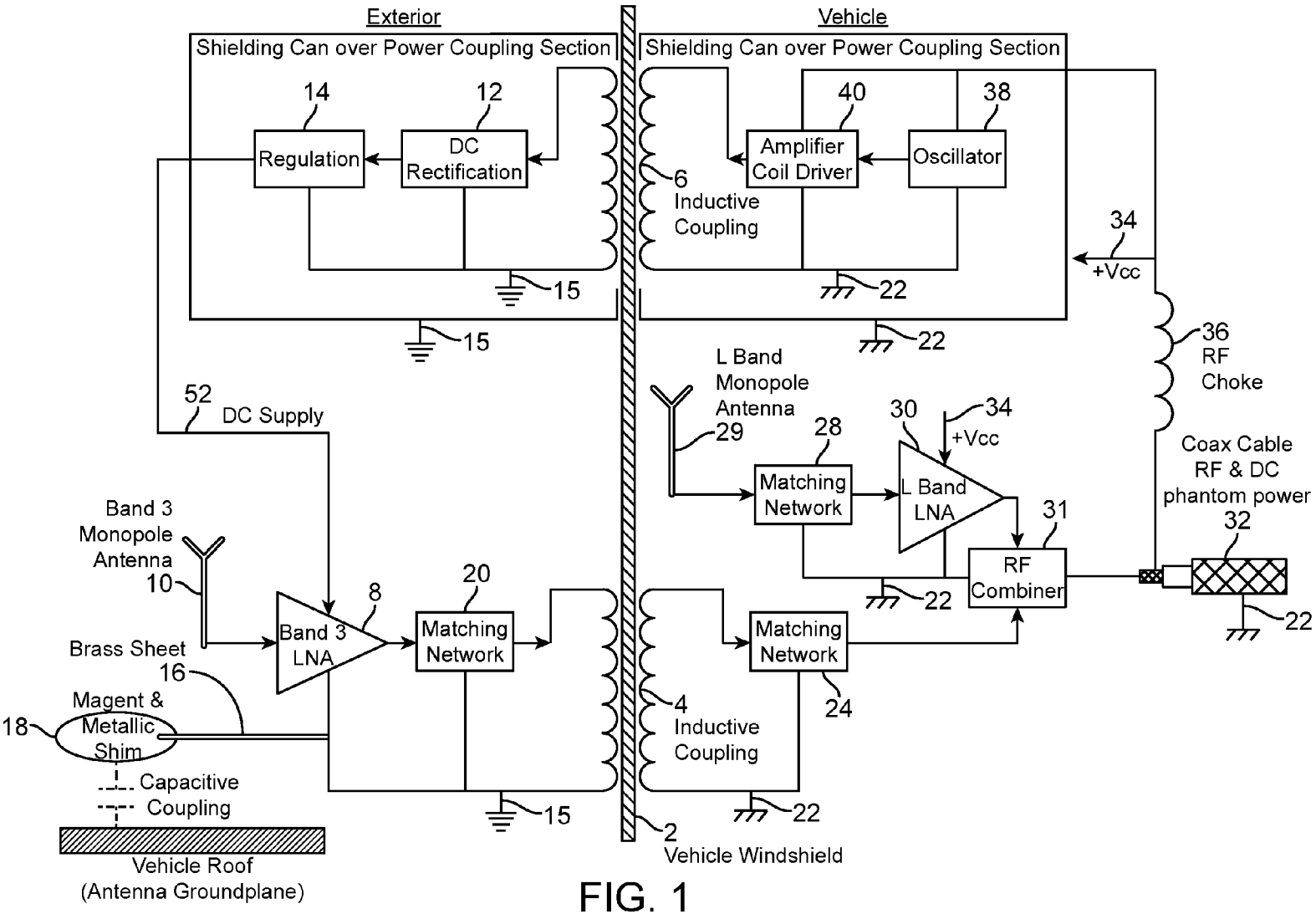
FIG. 1 shows an electrical diagram of an antenna system.

The diagram of FIG. 1 shows the electrical arrangement of the antenna. Signal transfer between inside and outside of the vehicle is through a vehicle window such as a car windshield (2) via two inductive couplings (4) and (6). Coupling (4) is for receiving signals from an external antenna and LNA section, coupling (6) is for providing DC power to a low noise amplifier (8) positioned at the monopole antenna (10). The inductive coupling (6) comprises of a ferrite primary coil which receives a very low frequency (VLF) signal on the vehicle side, which in turn generates a VLF signal on the exterior side of the inductive coupling in a ferrite secondary coil. This AC signal is DC rectified in a rectification unit (12) which provides a signal to a Low Dropout (LDO) regulation unit (14), which filters the unregulated DC and supplies a voltage regulated DC signal to a low noise amplifier (8). VHF filtering is provided and shielding is provided over VLF coupling and oscillator sections to reduce interference and noise.

The signal from the monopole antenna (10) forms the input to the low noise amplifier. The low noise amplifier is grounded at (15). The ground of the RF section comprises LNA (8), Matching network (20) and Antenna (10). This ground is capacitively coupled to the vehicle roof by use of a magnet and a metallic member or shim (18) connected to the Antenna assembly by a rubber coated flexible sheet brass band (16). In this example, the metallic shim is affixed to the roof due to the magnetic attraction between the roof and the magnet. However, in alternative examples, the metallic shim could also be adhesively fixed to the roof without using a magnet. In one example, the metallic shim comprises a 0.3 mm thick steel sheet of surface area 15 mm×15 mm.

The metallic shim is insulated from the roof by at least the thin layer of paint provided on the vehicle roof, and optionally by a thin layer of adhesive tape applied to the shim. As explained further below, this thin layer of insulation causes a capacitance between the two parallel metal plates, (namely the metallic shim and roof).

A DAB signal (for example) received by antenna (10) is amplified via the low noise amplifier (8) and is provided via a matching network (which provides an impedance transformation from the LNA output (8)) to the exterior side of inductive coupling (4). The signal provided is a VHF waveform and this will induce a corresponding VHF waveform in the vehicle side of the inductive coupling (4). Inductive coupling (4) is preferably formed from two printed circuit board (PCB) coils positioned opposite each other on exterior and interior of the glass. These coils are mutually inductive and form with the matching networks (24) and (20) a two port network matched to 50 ohms and tuned to pass the VHF band 3 signal. The low noise amplifier ensures that the signal provided to the inductive coupling has amplification before any significant loss has been introduced through the coupling network, thus providing the receiver with a high signal to noise ratio.

The received signal from inductive coupling (4) provided to the matching network (24) and other portions of the vehicle side circuitry are connected to a ground connection (22), which is connected to the vehicle ground at the RF and DAB receiver (not shown).

An internal L band monopole antenna (29) provides a signal to a matching network (28), which is amplified by L band low noise amplifier (30), this Band L signal and the Band 3 signal from the inductive coupling (4) are combined in an RF combiner (31). The signal from the RF combiner is provided to coaxial cable (32), also connected to vehicle ground (22) at the RF and DAB receiver.

An input voltage +Vcc (34) powers the vehicle side circuitry and is received from the coaxial cable (32) via an RF choke (36). It also powers the oscillator (38) and amplifier coil driver (40) which provides the oscillating signal to the inductive coupling (6) for producing power on the exterior side of the inductive coupling.

Figure 2:
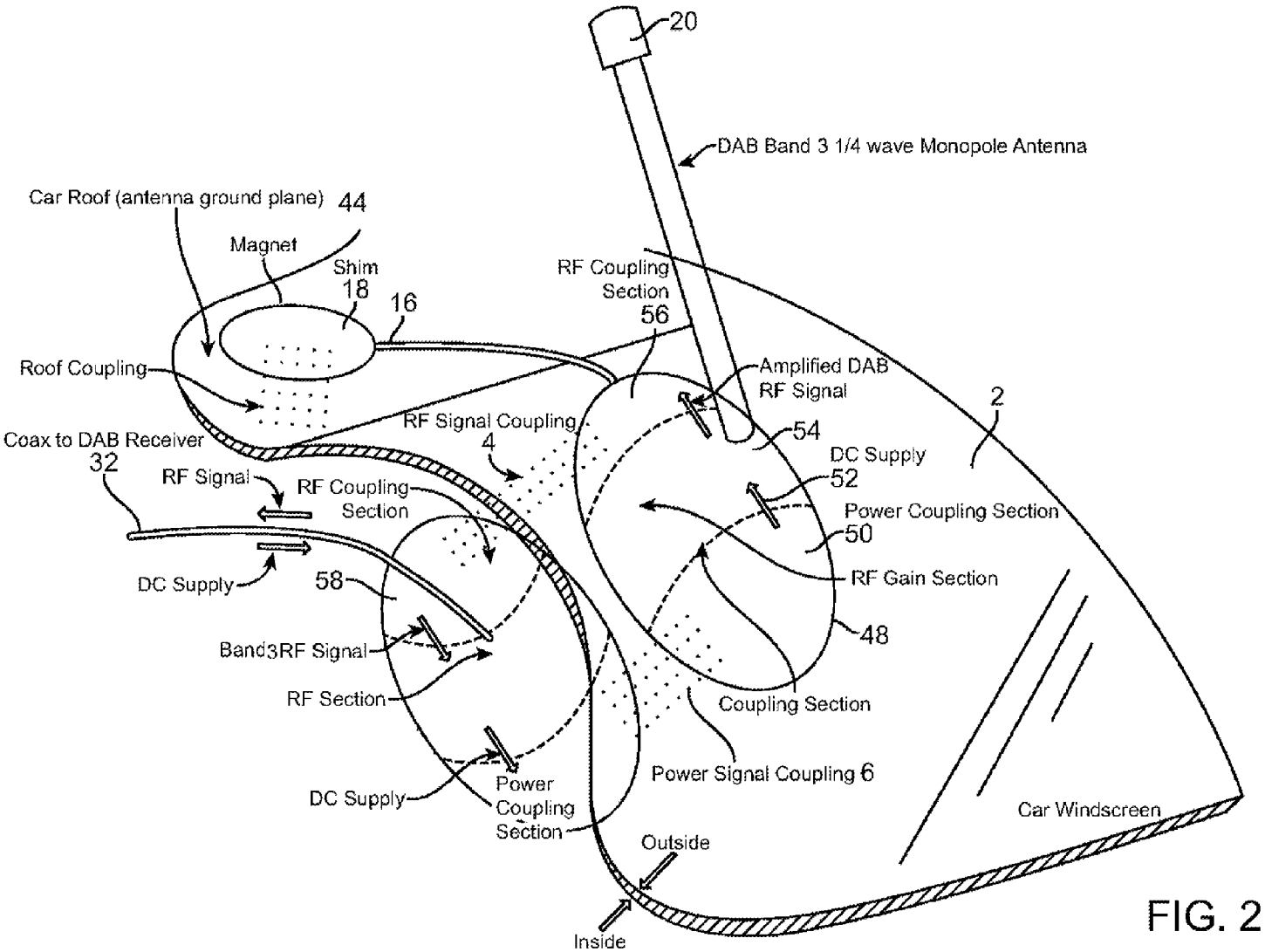
FIG. 2 shows a mechanical and electrical layout of an antenna system mounted on a vehicle window.

In FIG. 2, a 3d schematic of the physical embodiment of the antenna system is shown. In this, the metallic shim(18) which couples the antenna to the vehicle roof (44) which in turn acts as an Antenna counterpoise (or ground plane) is shown. In this example, the metallic shim (18) is attracted to the roof by a magnet positioned directly above it, such that the metallic shim is sandwiched between the magnet and the vehicle roof. The metallic shim (18) and magnet can be affixed within a "tail" assembly by a thin layer of adhesive tape. In one example, to form the "tail" assembly, the metallic shim (18) is connected by an 8 cm long 1 cm wide band of rubber coated 0.25 mm thick brass sheet (16) to an external coupling unit (48). The rubber coating is largely for aesthetic reasons. The magnet and metal shim are attracted to the roof, but insulated therefrom by the thin layer of paint (and optionally the adhesive tape), as discussed above.

In the coupling unit (48) the RF coupling section (56) is provided adjacent to a power coupling section (50) which includes the exterior side inductor as well as rectification unit (12) and regulation unit (14). This power coupling provides the DC supply (52) to the RF gain section comprising the band 3 low noise amplifier (8). Also, physically attached to this portion of the unit is the band 3 monopole antenna (10). This is mounted on the coupling unit at an angle that can be varied by the user and such that when the unit is lying flat against the windscreen the antenna projects up above the vehicle roofgiving an improved omnidirectional performance.

Signals received from the antenna via the RF gain section (54) are provided to an RF coupling section (56) which includes the exterior side of inductive coupling (4). This inductive coupling provides RF coupling to an internal RF coupling section (58) containing the vehicle side of inductive coupling (4). The Band 3 signal from (4) flows to the RF section where the impedance of the inductive coupling (4) is impedance matched to RF combiner (31). The Band L Signal received by the L Band Antenna (29) and amplified by L Band LNA (30) is summed with the Band 3 Signal at RF Combiner (31). The coaxial cable (32) then provides the DAB or RF signal to a DAB receiver. This coaxial cable also provides the DC supply (34) which is used to power the power coupling section of the internal screen mounting portion.

DETAILED EXPLANATION OF CAPACITIVE COUPLING TO THE VEHICLE ROOF

The connection to the vehicle roof is by capacitive coupling achieved using two conductive plates placed adjacent to one another. One plate comprises the vehicle roof and the other can be a metallic plate (the metallic shim 18) which is electrically connected to the Antenna system ground.

Capacitive coupling at RF frequencies is sufficient because a low impedance between the two conductive plates at the wanted frequency band can be achieved through the capacitance and therefore a conductive electrical contact or low DC resistance contact is not required. The impedance of the capacitive coupling can be calculated by $Xc=\frac{1}{2\pi fc}$. Where Xc is the impedance, f is the frequency. An example of a low impedance would be less than 0.2 ohm and the required capacitance to achieve 0.2 ohm at a frequency of 208 MHz would be 4 nF. Therefore, for example, the capacitance value ideally should be greater than 4 nF for a system where a DAB signal in band 3 is required for reception.

The capacitance formed between the two adjacent metallic surfaces is proportional to the surface area of the smallest plate (in this case the metallic shim) and inversely proportional to the distance between the two surfaces. The capacitance (C) between the vehicle roof and the metallic shim can be calculated by C=ErEo A/d. Where Er is the relative dielectric constant of the insulating material (i.e. plastic tape, paint), Eo is Permittivity of Free Space, A is the surface area of the conductive plate, d is the distance between the conductive plate and vehicle roof. A working example of the capacitance would be:

d (is small) at ~0.5 mm

Er, Relative Permittivity of plastic tape, paint ~3

Eo Permittivity of Free Space $8.8542^{-12}$

A=225 $mm^2$ (15×15 mm)

$Xc=3\times8.8542^{-12}\times225\ mm^2/0.5=11.95$ nF

The capacitive coupling is achieved by use of a metallic shim with a defined minimum surface area. The metallic shim can be fixed onto the roof by a magnetic connection or an adhesive connection, but other types of non-invasive connections are possible.

The efficiency of an Antenna relates directly to how well it can receive (or transmit) an RF signal, in a receiver this relates to how well it can transfer the received over-the-air signal into electrical energy at the receiver (or LNA) input. The S11 parameter is used to indicate the power transfer performance of an antenna. An ideal omnidirectional Antenna will receive a signal best when the signal is incident at right angles to the antenna, which is the normal incidence angle of ground based broadcasts to a vertical monopole (or whip) antenna. A Lambda/4 monopole Antenna was chosen for the design due to its known good omnidirectional performance when used for a vehicle antenna. The antenna element should be positioned vertically above the roofline which improves its omnidirectional performance due to it not being shadowed by the vehicle and therefore improves reception to signals travelling from a ground based transmitter.

Figure 3:
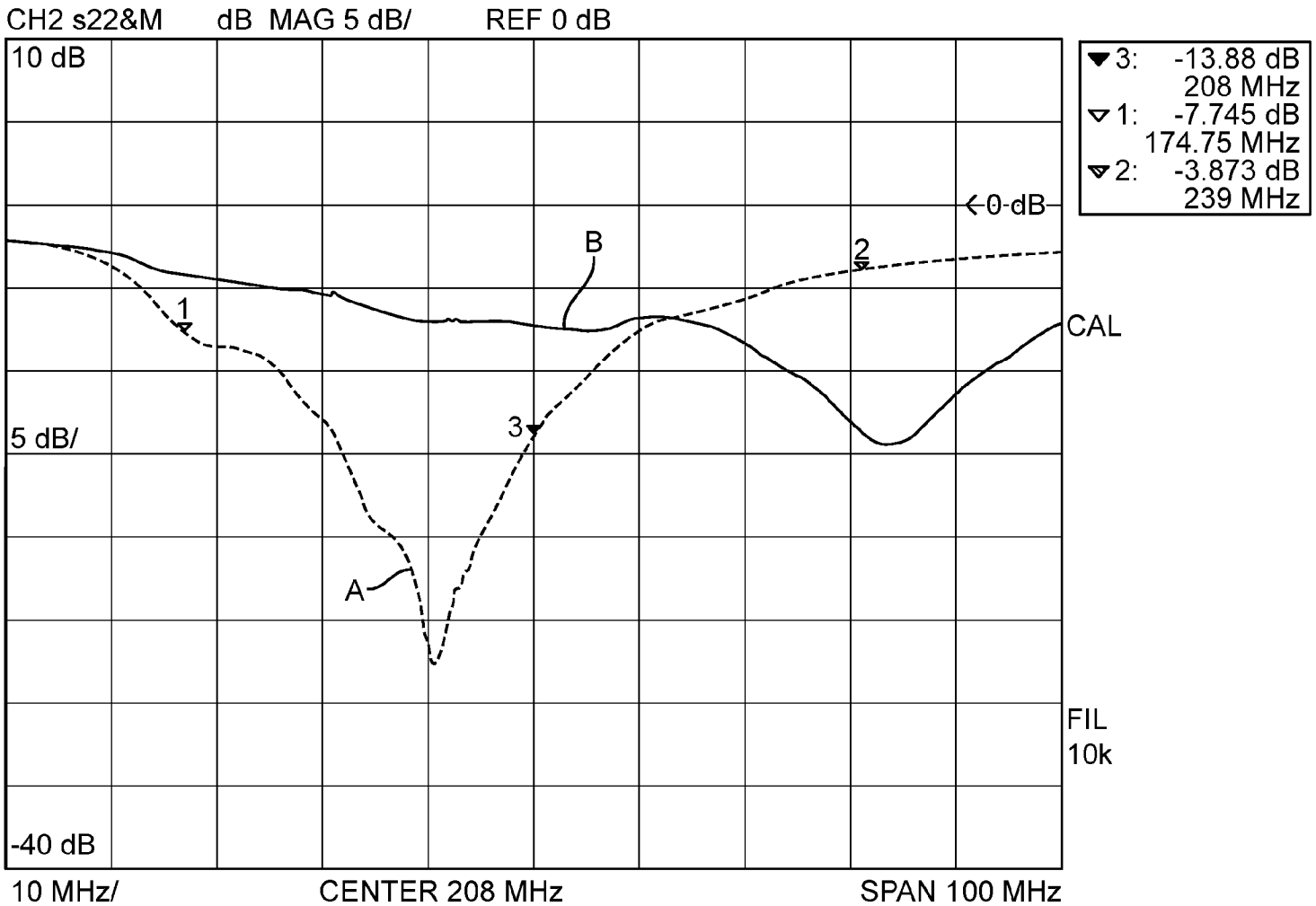
FIG. 3 shows a performance graph for the S11 frequency response of an antenna with and without a capacitively coupled ground plane; and, FIG. 4 shows the signal to noise response of an antenna in accordance with an embodiment of the invention in comparison to other antenna arrangements.

A Monopole antenna is an unbalanced dipole antenna and requires a ground plane (or antenna Counterpoise) to work as the other half of the antenna. A perfect lambda/4 monopole with a perfect ground plane should give an impedance of roughly half of a dipole Antenna, close to 37.5Ω which is easily impedance matched to the 50Ω receiver and therefore a simple low loss matching network can be used. The diagram of FIG. 3 shows the S11 frequency response of the monopole Antenna and between markers 1 & 2 the normalised (to 50Ω) impedance of the antenna over the full band 3 DAB signal range (174 MHz to 240 MHz) can be seen. The trace A shows the response for an Antenna with a (capacitively coupled to) car roof ground plane, the trace B shows the Antenna with no capacitive coupling to the car roof ground plane. As can be seen, the trace A shows an Antenna with an improved reflection coefficient and therefore is much more efficient at receiving a signal over the band of interest than the B trace.

In order to maximise performance for an antenna, the ground plane area should be larger than ¼ wavelength on each side in the frequency band of interest. For example in the VHF DAB band (known as band 3) the central frequency is ~208 MHz, at 208 MHz the wavelength is 1.4 m and therefore ¼ wavelength is 35 cm). A typical vehicle roof is larger than ¼ wavelength in each direction and therefore works well as a groundplane for the VHF DAB band. Bandwidth is particularly important with DAB reception which has a wide frequency band from 174 MHz to 240 MHz as can be seen in the S11 plot of FIG. 3 which shows the return loss (impedance match) of the lambda/4 monopole using a ground plane (i.e. car roof). The size of the ground plane improves aspects of the Antenna including impedance, bandwidth and efficiency and any reduction in ground plane size below the minimum discussed can give a reduction in overall Antenna performance.

Using the capacitive to the roof as ground plane is much more efficient than connecting to the negative terminal of the car battery, as the length of cable required would have a relatively high inductance and would not give a low impedance connection.

Figure 4:
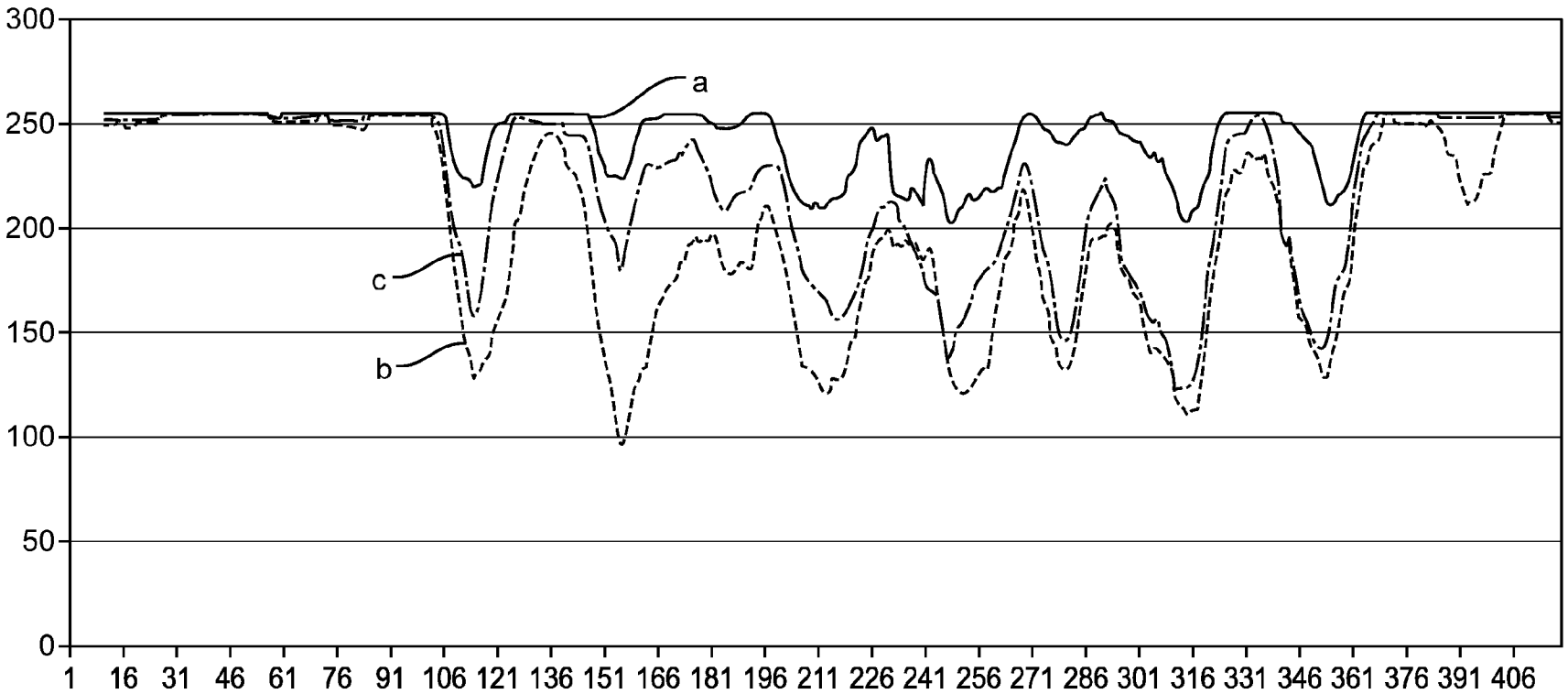

A working test has been conducted to compare the performance of an antenna embodying the invention with a capacitive coupling to the roof to provide a ground plane with one that is not coupled to the roof but is a close proximity to it and also to compare it with a film on glass antenna fitted to the inside of the windscreen. The results of this test are shown in FIG. 4. The vertical axis of this shows the signal to noise ratio in which a level of 100 or below represents failure to correctly receive the DAB signal and reproduce audio and a level of 255 is the maximum. Each increment of 50 represents a difference in signal level of 5 DB (where 6 DB is half the received power). The horizontal axis is time elapsed as the vehicle went along a route.

The three traces in FIG. 4 are:

a) A through glass antenna with capacitive coupling to the roof.

b) A through glass antenna with no capacitive coupling to the roof but with the antenna positioned in close proximity to the roof.

c) A film on glass antenna fitted to the inside of the windscreen.

As can be seen the through glass antenna with no capacitive coupling to the roof gives poor performance and at one instance dropped below 100 DB which would represent failure to correctly receive the DAB signal. It is likely, therefore, that its performance would be unacceptable.

The capacitive coupling to the roof gives significant improvement in signal to noise ratio which on this particular route did not drop below 200. The film on glass antenna demonstrated a wide range of signal to noise ratios going as low as approximately 100. It is therefore clear that the capacitive coupling to the roof gives a significant improvement in performance for DAB reception.

The invention claimed is:

1. An RF antenna system for mounting on a window of a vehicle, the antenna system comprising an exterior window mountable portion for mounting on the exterior of a window, wherein the exterior mountable portion comprises:

an antenna; and a metallic member electrically connected to the exterior mountable portion and arranged to affix to a roof of the vehicle using a magnet and to capacitively couple to the vehicle roof thereby providing a ground plane for the antenna.

2. An RF antenna system according to claim 1 in which the metallic member comprises a sheet metal shim.

3. An RF antenna according to claim 2 in which the magnet is mounted above the sheet metal shim and is arranged to hold the shim to the roof.

4. An RF antenna system according to claim 2 further comprising a layer of insulating material provided over the shim to insulate it from the roof when affixed thereto.

5. An RF antenna system according to claim 4 in which the insulating material comprises adhesive tape.

6. An RF antenna system according to claim 1 in which the metallic member is electrically connected to the exterior mountable portion by a flexible sheet metal band.

7. An RF antenna system according to claim 1 further comprising an interior mountable portion for mounting on an interior side of the window.

8. An RF antenna system according to claim 7 in which the interior mountable portion is mountable opposite to the exterior mountable portion.

9. An RF antenna system according to claim 7 in which the exterior and interior mountable portions comprise an RF coupling section for inductively coupling an RF signal received from the antenna on the exterior of a vehicle to the interior portion.

10. An RF antenna system according to claim 9, further comprising a power coupling section for providing power from the interior mountable portion to the exterior mountable portion to power an amplification portion in the exterior portion for amplifying received RF signals.

11. An RF antenna system according to claim 10 in which the power coupling section comprises a ferrite core in each of the interior mountable and exterior mountable portions.

12. An RF antenna system according to claim 9, in which the RF coupling section comprises a printed circuit board coil in each of the interior mountable and exterior mountable portions.

13. An RF antenna system according to claim 1, wherein a signal received using the antenna is provided as input to a Digital Audio Broadcast (DAB) receiver.

14. An RF antenna system according to claim 1 in which the metallic member comprises a shim formed from a corrosion-resistant, electrically conductive metal.

15. An RF antenna system according to claim 1, wherein the metallic member is sized to provide an impedance of less than around 0.2 ohms at a signal frequency to be received by the antenna.

16. An RF antenna system according to claim 1, wherein the metallic member is planar and arranged to be disposed generally parallel to the vehicle roof, the metallic member having an area determined based on having the metallic member provide an impedance of less than around 0.2 ohms at a frequency of a signal to be received by the antenna.

17. An RF antenna system according to claim 1, further comprising a layer of insulating material disposed between the metallic member and the vehicle roof, wherein the metallic member is arranged to be disposed generally parallel to the vehicle roof, and the metallic member has an area and the layer of insulating material has a thickness determined so that a capacitance between the metallic member and the vehicle roof provides an impedance of less than around 0.2 ohms at a frequency of a signal to be received by the antenna.

18. An antenna system capable of being mounted on a window that separates an interior space from an exterior space, comprising:

an exterior window mountable portion for mounting on the exterior of the window, wherein the exterior mountable portion comprises:

an antenna and a metallic member electrically connected to the antenna and arranged to be capacitively coupled to a generally planar conductive surface having an area at least approximately the square of one fourth of a wavelength of a signal to be received by the antenna, wherein the metallic member comprises a magnet arranged for physically coupling the metallic member with the generally planar conductive surface.

19. An RF antenna system for mounting on a window of a vehicle, the antenna system comprising an exterior window mountable portion for mounting on the exterior of a window, wherein the exterior mountable portion comprises:

an antenna, and a metallic member electrically connected to the exterior mountable portion and arranged to affix to a roof the vehicle using a magnet and to capacitively couple to the vehicle roof thereby providing a ground plane for the antenna; and an interior mountable portion for mounting on the interior of the window.

20. An RF antenna system for mounting on a window of a vehicle, the antenna system comprising:

an exterior window mountable portion for mounting on the exterior of a window, wherein the exterior mountable portion comprises:

an antenna, and a metallic member electrically connected to the exterior mountable portion and arranged to affix to a roof of the vehicle and to capacitively couple to the vehicle roof thereby providing a ground plane for the antenna; and a layer of insulating material disposed between the metallic member and the vehicle roof, wherein the metallic member is arranged to be disposed generally parallel to the vehicle roof, and the metallic member has an area and the layer of insulating material has a thickness determined so that a capacitance between the metallic member and the vehicle roof provides an impedance of less than around 0.2 ohms at a frequency of a signal to be received by the antenna.

* * * * *